United States Patent [19]

Murphy

[11] 4,389,829

[45] Jun. 28, 1983

[54] METAL ROOF SYSTEM

[76] Inventor: Wesley T. Murphy, 94 Prospect St., Auburn, N.Y. 13021

[21] Appl. No.: 219,262

[22] Filed: Dec. 22, 1980

[51] Int. Cl.[3] ..... E04C 3/02

[52] U.S. Cl. ..... 52/693; 403/230; 403/280; 403/297; 52/90; 52/639

[58] Field of Search ..... 52/690–694, 52/639–644, 655, 656, 585, 90; 403/230, 231, 233, 237, 161–163, 377–379, 274, 292, 297, 280; 29/155 R

[56] References Cited

U.S. PATENT DOCUMENTS

| | | | |
|---|---|---|---|
| 408,750 | 8/1889 | Rockwell et al. | 403/237 |
| 1,854,144 | 4/1932 | Shrosbree et al. | 52/656 |
| 1,924,881 | 8/1933 | Ragsdale | 52/692 |
| 2,234,960 | 3/1941 | Buelow | 403/233 |
| 2,272,910 | 2/1942 | Gobberdiel | 52/588 |
| 3,229,333 | 1/1966 | Hillesheim et al. | 403/231 |
| 3,680,277 | 8/1972 | Martin | 52/438 |
| 3,708,942 | 1/1973 | Leonard | 52/693 |
| 3,952,461 | 4/1976 | Kinsey | 52/588 |
| 4,030,264 | 6/1977 | Jackson | 52/693 |
| 4,123,881 | 11/1978 | Muse | 52/438 |

*Primary Examiner*—James L. Ridgill, Jr.
*Attorney, Agent, or Firm*—Bruns & Jenney

[57] ABSTRACT

A roof system of the type wherein a rafter and a purlin are connected by a sheet metal truss. The truss contains a pair of channel-shaped mounting flanges that are hinged to the member at each end thereof. One flange is adapted to pass over and be seated upon the rafter while the opposite flange is adapted to pass over the purlin. In assembly, the flanges are brought into alignment with holes formed in the rafter and the purlin and the truss is secured in place using a spring loaded truss pin that can be easily deformed in assembly to provide a rivet-like connection between the cojoined members.

3 Claims, 5 Drawing Figures

METAL ROOF SYSTEM

BACKGROUND OF THE INVENTION

This invention relates to sheet metal building construction and, in particular, to a roof support system for use in a structure using sheet metal framing members.

As evidenced by the roof systems disclosed in U.S. Pat. Nos. 3,952,461 and 2,272,910, most buildings utilizing sheet metal construction abandon the traditional roof type system involving the use of rafters and purlins in favor of single piece roof sections. In this type of construction, support for the roof is provided by reinforcing ribs that are adapted to coact with the roof comb. Although the single piece roof arrangement has proven to work quite well in practice, it nevertheless requires that each of the interlocking pieces that make up the individual roof sections be precisely fabricated so that they come together properly in assembly without bending or otherwise deforming the parts. To precisely form the parts requires special tooling which is not only expensive but also difficult to maintain within working tolerances. As a consequence, the cost of the component parts is high and the scrap rate is also high. Similarly, because supporting truss and purlins are not used, the amount of roof area covered by the sections is also restricted.

Most buildings utilizing specially designed sheet metal roof sections are generally modular units which afford little or no flexibility of design. Accordingly, many buildings employing sheet metal construction tend to be box-like structures having relatively little if any aesthetic value. For this reason architects and designers have generally avoided using sheet metal roof systems in their structures.

SUMMARY OF THE INVENTION

An object of the present invention is to improve sheet metal roof support systems.

A further object of the present invention is to provide a sheet metal roof support system that is inexpensive to construct and easy to assemble and install.

A still further object of the present invention is to provide a sheet metal roof support system that contains an adjustable truss member which can be simply and accurately fitted without special tools in assembly.

Another object of the present invention is to provide a sheet metal roof support system that does not require precisely fabricated component parts.

Yet another object of the present invention is to provide greater freedom of design in roof support systems utilizing sheet metal members.

Still another object of the present invention is to provide a sheet metal roof support system that contains structural members that can be joined together in assembly using a simple truss pin.

These and other objects of the present invention are attained by means of a roof support system having sheet metal rafters and purlins that are connected by sheet metal trusses having hinged mounting flanges at both ends that are brought into overlapping alignment with the rafters and purlins in assembly to provide a high strength, structurally tight unit. In assembly, the mounting flanges are secured to the rafters and the purlins by means of a simple flat spring pin that is easily deformed after it is assembled to provide a rivet-like joint between the structural members.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 2:
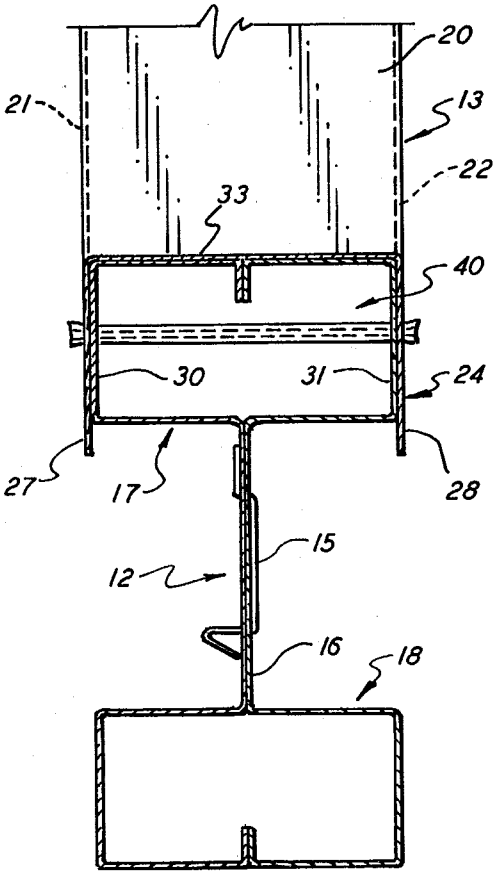
FIG. 2 is an enlarged section taken along lines 2—2 in FIG. 1 showing one end of a truss member utilized in the present invention secured to a horizontally aligned purlin.
Figure 1:
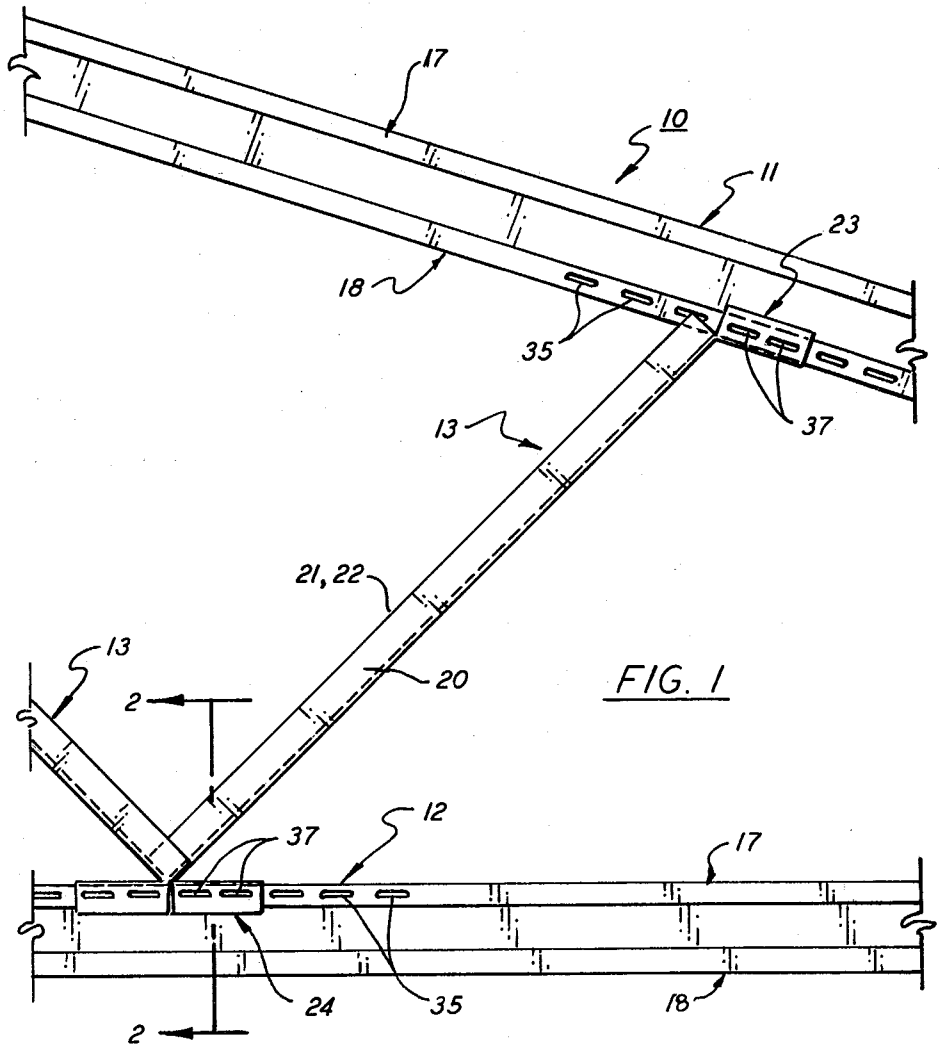
FIG. 1 is a partial side elevation of a roof system employing the teachings of the present invention.

Referring initially to FIG. 1, there is shown a roof support system, generally referenced 10, employing sheet metal members that are brought together to provide a structurally tight, high strength assembly. The system includes a plurality of rafters 11 that are connected to companion purlins 12 by means of truss members 13, the connected members coacting to establish a support system of conventional design as typically used in buildings and other similar small structures. The rafter members and the purlin members are both made of sheet metal and are of similar construction. The rafters and purlins are both fabricated by bringing together two structural members of the type described in U.S. Pat. No. 4,192,119 to form a beam. As illustrated in FIG. 2, two structural members of the type described in the noted patent are placed in a face to face relationship and are secured together using a number of metal clips 15. By virtue of this arrangement, the beam as formed contains a central web 16 and a pair of box-like support flanges that will herein be referred to as upper support flange 17 and lower support flange 18.

It should be noted at this point that teachings relating to the subject structural member contained in the above noted patent are herein incorporated by reference.

The truss members employed in the instant roof system are each channel-shaped elements having an elongated, flat body section 20 or web from which depends a pair of longitudinally extended side walls 21,22. Each truss is provided with a pair of channel shaped mounting flanges 23,24 that are hingedly secured to each end of the truss member. The end flanges are adapted to slip over the mounting flanges carried by the rafters and purlins and provide a positive seat for the trusses.

Although the mounting flanges may be secured to the truss using independent hinge mechanisms, it is preferred that the truss and mounting flanges be formed from a single piece of sheet metal that is roll formed into a channel configuration. The truss is cut to a predetermined length that includes the span between the rafter and the purlin and the required length of the two mounting flanges. A saw cut is made in the sidewalls of the member some distance back from each end face which defines the length of the flange. The cut is made normal to the plane of the body section of the truss and passes inwardly from the distal edge of the two side walls to the inside wall of the body section. Accordingly, the flanged ends of the member can be back bent about the body section along a pivot axis that lies within the plane of the cut.

The inside dimension of the channel-shaped truss, that is, the distance between the side walls, is equal to or slightly greater than the overall width of the rafter and purlin support flanges. As best illustrated in FIG. 2, the mounting flanges on the ends of the truss are slipped over the support flanges on the rafters and purlins. The sidewalls 27 and 28 of the mounting flange in assembly overlap the side walls 30 and 31 of the receiving support flange to prevent the truss from shifting laterally. The mounting flanges are also securely seated upon the top surface of the support flanges to provide an extremely stable mounting pedestal for the truss members.

The lower flange 18 of the rafters and the upper flange 17 of the purlins each contain a series of equally-spaced, elongated oval shaped receiving holes 35—35 passing transversely therethrough. The spacing between the receiving holes contained in the rafter and purlin is identical to that maintained between a pair of complimentary oval shaped holes 37—37 provided within the side walls of the two mounting flanges 23,24. When the mounting flanges on the truss member are seated in overlying relationship with the support flanges on either the rafters or the purlins, the complimentary hole pairs are brought into axial alignment with the receiving holes contained in the joined member. Once aligned, truss pins 40 are inserted into the hole pairs to secure the structural members in assembly.

Figure 3:
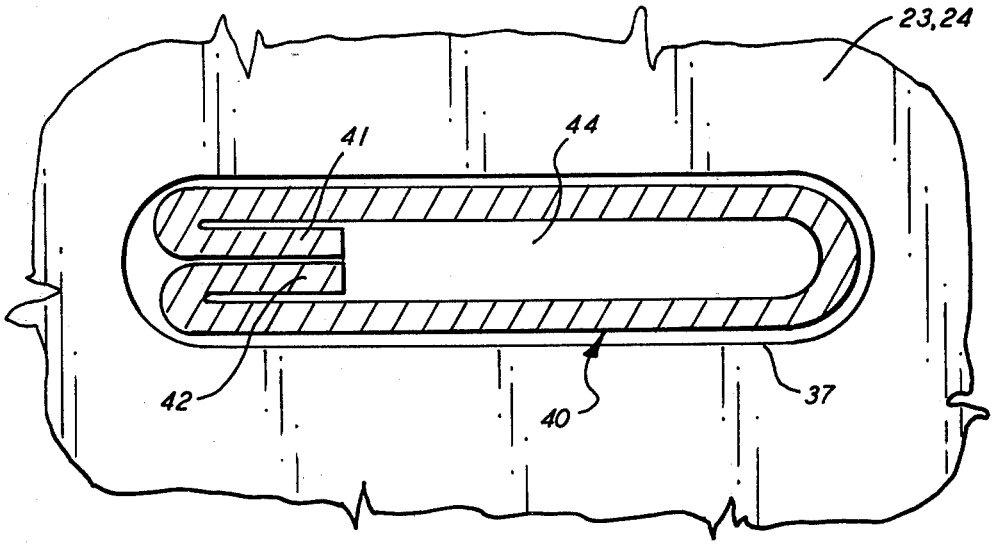
FIG. 3 is an enlarged end view in partial section further illustrating the construction of a truss pin member used to secure the truss members to the companion rafter and purlin member showing the pin compressed within a receiving hole.
Figure 4:
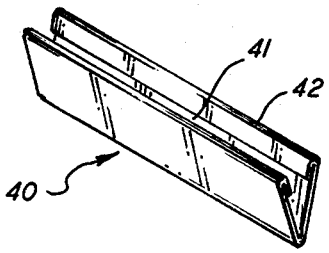
FIG. 4 is a perspective view of the truss pin shown in FIG. 3 showing the pin in an unloaded or free position.
Figure 5:
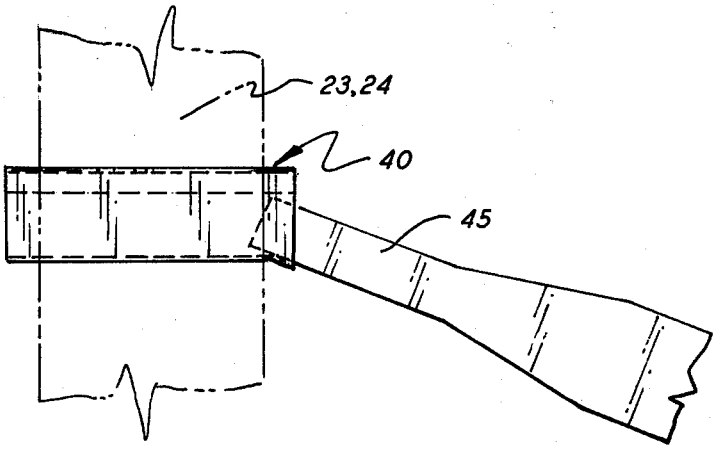
FIG. 5 is a side view of the truss pin illustrating one end of the pin being deformed to create a rivet-like closure.

With further reference to FIGS. 3–5, the truss pin is a V-shaped member that is fabricated from a single piece of metal having a spring coefficient that enables the pin to exert a biasing force against the walls of the coaligned receiving holes 35 and 37 in assembly.

A pair of margin pads 41 and 42 are formed along the longitudinal edges of the pin by turning the edges inwardly upon themselves. To insert the pin in the holes, the pin is compressed to bring the two pads into contact with each other. When so compressed the pin forms a flat member that can be slidably received within the aligned elongated holes. A close sliding fit is provided between the outer surface of the compressed pin and the inner wall of the holes. Accordingly, when the compressive force upon the pin is released, the pin springs into biasing contact with the cojoined members. Sufficient radial force is exerted upon the members to help hold the members in alignment in assembly.

The axial length of the truss pins is greater than the overall width of the hinged mounting flanges. A portion of the pin, in assembly, is allowed to extend outwardly some distance from each side wall of the flange to provide sufficient material to enable the pin to be deformed against the structural members. To secure the pin in place, the blade of a screwdriver 45 is inserted into the opening 44 provided in the pin between lips 41 and 42. The screwdriver blade is used as a lever to crimp the ends of the pin back as illustrated in FIG. 5. The ends of the pin are deformed sufficiently to prevent the pin from moving laterally within the cojoined member. This, along with the pin's biasing action, provides a rivet-like connection that serves to tightly join the members in assembly.

As should be evident from the present disclosure, the hinged mounting flanges carried on each end of the truss members permit the trusses to be quickly and accurately aligned with both the rafters and the purlins regardless of the angular displacement between the members. Once aligned spring-loaded truss pins of the type herein described can be easily slipped into place and locked in assembly to securely join the roof member into a stable, high strength unit.

While this invention has been described in reference to the disclosure herein set forth, it is not necessarily limited to this particular embodiment and this application is intended to cover any modifications or changes as may come within the scope of the present invention.

I claim:

1. A metal roof support structure that includes a metal rafter member and a generally opposed metal purlin member each member having a central web and a pair of mounting flanges secured to each end of the web that contain a series of spaced apart elongated holes passing through the flanges thereof, at least one metal truss for connecting the rafter and the purlin, said truss being formed of a channel shaped member having a base and two opposing side walls, the side wall of the channel having a transverse cut form therein at a predetermined distance from each end of the truss, each cut passing inwardly from the outer edge of the side wall to the base to allow the end sections of the truss to be bent about the base, the inside width between the side walls of the truss being equal to or slightly greater than the outside width of the purlin and rafter flanges so that the end sections of the truss are slidably received over the flanges and can be bent into conformity therewith, the side walls of the end sections of said truss member having at least one elongated hole formed therein that compliments the holes formed in the side walls of said flanges whereby said holes are brought into alignment in assembly, and a resilient V-shaped truss pin mounted in the aligned holes that is biased into contact against the truss and the mounting flanges to secure the members in assembly.

2. The metal roof system of claim 1 wherein the ends of the truss pins extend outwardly beyond the side walls of the end sections of the truss and are flared radially to prevent the pins from passing laterally out of the aligned holes.

3. The metal roof system of claim 2 wherein the truss pins contain longitudinally extended pads positioned along the inside edges that, when brought together, establish an axial opening in said pin.

* * * * *